US005896620A

United States Patent [19]

Mink

[11] Patent Number: 5,896,620

[45] **Date of Patent: *Apr. 27, 1999**

[54] EASY GRIP BRUSH HANDLE

[75] Inventor: Jeffrey Mink, Glen Head, N.Y.

[73] Assignee: F. M. Brush Co., Inc., Glendale, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/834,260

[22] Filed: Apr. 15, 1997

[51] Int. Cl.[6] ..... A47B 95/02

[52] U.S. Cl. ..... 16/110 R; 16/114 R; 16/111 R

[58] Field of Search ..... 16/110 R, 111 R, 16/121, 110.5, 114 R, DIG. 12, DIG. 19; 30/294; 206/15.2; 15/246, 143.1; 81/489, 177.1; D4/138; 76/106, 119; D7/688, 691, 369, 368, 393, 395; D8/107, 98

[56] References Cited

U.S. PATENT DOCUMENTS

| | | | |
|---|---|---|---|
| 168,187 | 9/1875 | Schermerhorn | 206/15.2 |
| 264,527 | 9/1882 | Haley | 81/177.1 |
| 264,798 | 9/1882 | Tyler | 81/177.1 |
| 375,773 | 1/1888 | Rockwell | 16/110 R |
| D. 388,961 | 1/1998 | Berti | D4/138 |
| 1,655,950 | 1/1928 | Griswold | 206/15.2 |
| 2,141,531 | 12/1938 | Graham | 206/15.2 |
| 2,964,045 | 12/1960 | Otto et al. | 206/15.2 |
| 3,015,120 | 1/1962 | Anderson | 206/15.2 |
| 4,109,339 | 8/1978 | Dietrich | 15/143.1 |
| 4,376,536 | 3/1983 | Martin | 16/DIG. 12 |
| 4,784,025 | 11/1988 | Peck | 81/489 |
| 4,961,717 | 10/1990 | Hickey | 206/15.2 |

*Primary Examiner*—Chuck Y. Mah

*Attorney, Agent, or Firm*—Michael J. Brown; John L. Chiatalas; Irving M. Fishman

[57] ABSTRACT

A substantially egg or tear drop shaped handle in which a segment, parallel to the major axis, has been cut away so as to provide a flat surface. Either end of the major axis of the substantially egg shaped handle or the non-rounded (i.e. pointed) end of the substantially tear shaped handle is adapted to receive, adapted to be received by, or integrally manufactured with, the item to be held by the handle. The flat surface is available as a thumb rest. Preferably the handle is of a size that when the thumb is against the flat side, the end of the major axis which is not attached to anything rests comfortably against a portion of the palm.

10 Claims, 3 Drawing Sheets

FIG. 1
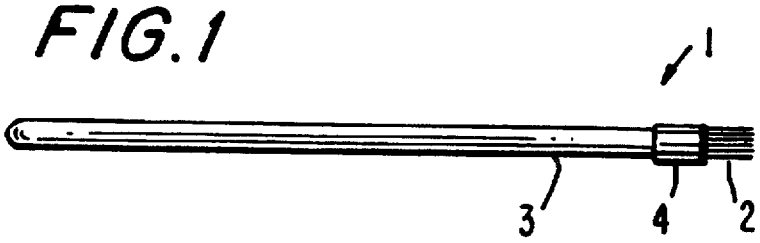
FIG. 2
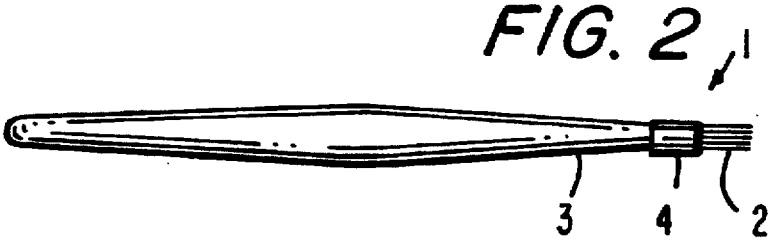
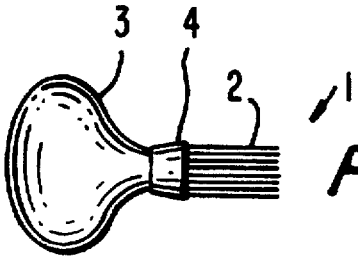
FIG. 3
FIG. 4
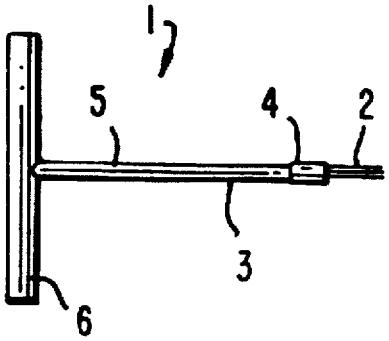

EASY GRIP BRUSH HANDLE

FIELD OF THE INVENTION

The present invention relates to the field of brush handles, especially handles for brushes in the cosmetic, nail, artistic, ceramic and craft/hobby industries. It also especially relates to the field of handles for brushes and other tools where the user may have difficulty in gripping or using the handle of an item, whether or not a brush.

BACKGROUND OF THE INVENTION

Handles for implements of all kinds have been in use for centuries. Unfortunately, the handles themselves have undergone little variation or development over the years and, in many instances, are quite cumbersome for the user.

Handles for brushes have been, for the most part, of two general types, pencil-like and door-knob like. The pencil like handles are generally cylindrical and typically have a circular cross-section. Some brush handles of this type have a slight thickening of the diameter near the center of the handle giving the axial cross-section an arcuate look, making the handle a bit more comfortable. However, in general, even these pencil-like handles still have the attributes of and the deficiencies of purely cylindrical handles.

Door-knob like handles are generally easier to grip than pencil-like handles, but they have their own problems. In many instances where control of the item being held by the handle is crucial, as in painting (artistic), use of nail brushes, applying cosmetics, or the use of craft/hobby brushes, the door-knob like handles do not allow for precise control. With handles of the door-knob variety, the motion needed to move the item to which the handle is attached is from the wrist rather than the fingers. This results in a substantial loss of precise control over the item.

Other handles for brushes which have been used in the past include various product caps which have a brush affixed to the cap for storage in the container to which the cap is applied when it is not in use. Generally, these caps age not suitably shaped to allow for comfort of use and for precise control over the brush. Most of these caps are cylindrical in shape with a wide diameter and relatively short length. In fact they could be described as being of the door-knob type, having the defects associated with those types of handles. Typical of these are brush caps found in the nail polish and typographic correction fluid areas.

Still other handles for other implements such as hand tools are generally cylindrical in overall shape, but they may also have regular polygonal cross sections to allow for gripping. These handles may have more complex cutouts along the circumference of the cylinder (aligned axially) to allow for even greater gripping. These are typically found on tools that require substantial torques applied, such as screwdrivers, hand drills, awls, etc. Such tools are not concerned with the comfort of the handle to the user or with the fine control of the item held by the handle. In these tool applications, the ability to deliver the appropriate torque is of greater concern.

In addition to these issues, many people have some limitation to their manual dexterity. This is especially so for those who have medical conditions which do not allow for firm gripping of the pencil-like handles of the past, especially those afflicted with arthritis, and other such conditions. For these people, items having handles of the pencil-like type cannot be grasped as efficiently as they are intended to be, resulting in alternate techniques such as wrapping the fingers circumferentially about the handle so that motion needed to utilize the item would have to come from wrist or the entire arm. This leads to very little control over the item to which the handle is attached, a result which is totally unacceptable in areas such as artistic, craft and hobby work and application of cosmetics.

Furthermore, those persons having disfigurements of the hands, typically in the ends of the fingers often have difficulty in utilizing implements with the standard pencil-like handles. For many applications, such handles are all that is currently available. For other applications, the door-knob like handles are available, but they do not offer the degree of control which would be desirable for these individuals.

OBJECTS OF THE INVENTION

It is therefore an object of the invention to provide a handle which is easier to grip than the pencil-like handles of the art.

It is another object of the invention to provide a handle which is easier to grip than the door-knob like handles of the art.

It is still another object of the invention to provide an easy-grip handle which maintains the control over the item attached to the handle typically associated with pencil-like handles.

Yet another object of the invention is to provide an easy-grip handle for use by those with a manual disability, which disability makes use of known pencil-like handles difficult or uncomfortable.

Still another object of the invention is to provide a handle which produces less cramping of the hand and/or arm than the known pencil-like or door-knob like handles when in use for an extended period of time.

An even further object of the invention is to provide such handles for the artistic, cosmetic, nail, ceramic and craft/hobby industries.

Yet an even further object of the invention is to provide such handles for brushes.

Still other objects of the invention will be apparent to those of ordinary skill in the art.

SUMMARY OF THE INVENTION

These and other objects of the invention can be achieved by a substantially egg or tear drop shaped handle having a major and minor axis, in which a segment, parallel to the major axis, has been cut away so as to provide a flat surface, either end of the major axis of the substantially egg shaped handle or the non-rounded (i.e. pointed) end of the substantially tear shaped handle being adapted to receive, adapted to be received by, or integrally manufactured with, the item to be held by the handle. The flat surface is available as a thumb rest. Preferably the handle is of a size that when the thumb is against the flat side, the end of the major axis which is not attached to anything rests comfortably against a portion of the palm.

BRIEF DESCRIPTION OF THE DRAWINGS

FIG. 1 is a view of a brush with a pencil-like handle of the art.

FIG. 2 is a view of a brush with a pencil-like handle of the art with an arcuate axial cross-section.

FIG. 3 is a view of a brush with a door-knob like handle of the art.

FIG. 4 is a view of a brush integrated into a container cap of the art.

DETAILED DESCRIPTION OF THE INVENTION

Figure 5:
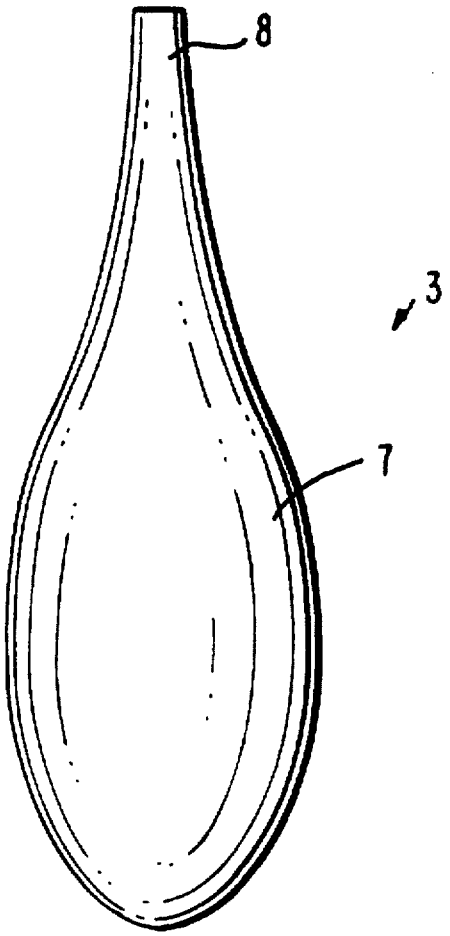
FIG. 5 is a top view of an egg shaped handle of the invention.
Figure 6:
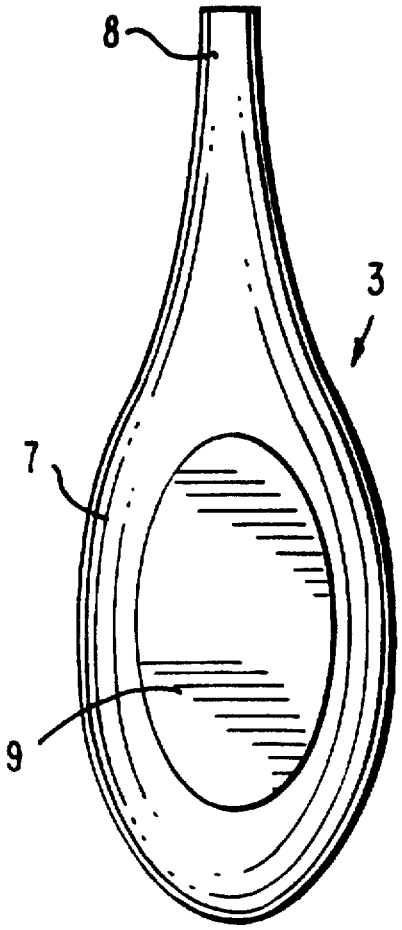
FIG. 6 is a bottom view of an egg shaped handle of the invention.
Figure 7:
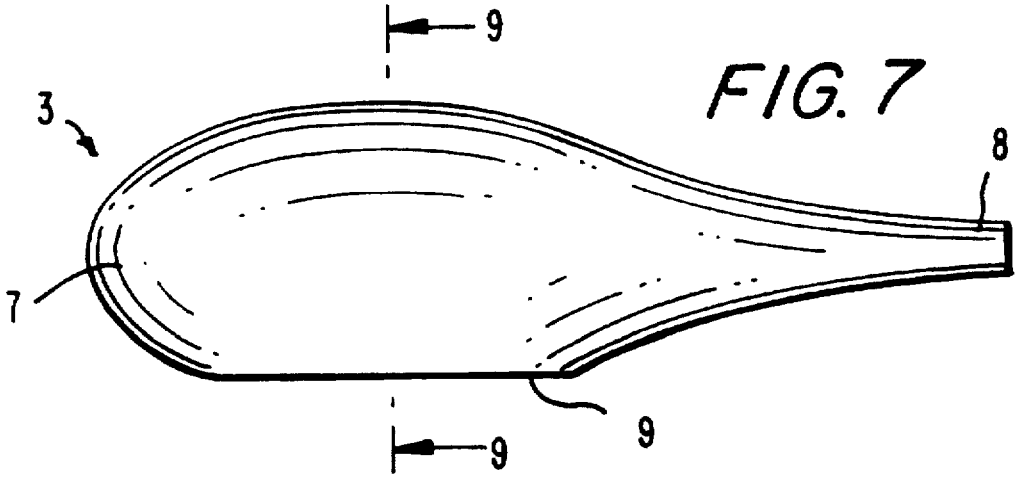
FIG. 7 is a side view of an egg shaped handle of the invention.

With reference to the drawings (which exemplify, but do not limit the invention), in which like numbered parts represent like items, FIGS. 1–4 represent various brush handles of the art, while FIGS. 5–7 represent the invention. FIGS. 1–4 show standard prior art brushes 1 with brush segment 2, various handles 3 (made up of stem 5 and cap 6 in FIG. 4), and connection means 4. FIGS. 1 and 2 are of the pencil type. In FIG. 1, handle 3 is cylindrical or substantially so, having a substantially rectangular axial cross-section. In FIG. 2, handle 3 has an arcuate axial cross-section, giving an appearance of the rectangular axial cross-section of FIG. 1 being slightly bowed outward from the center (convex). FIG. 3 is a door-knob-like handle of the art, while FIG. 4 is a brush-in-cap handle of the art where, as stated above, the handle 3 is made up of stem 5 and cap 6. Brushes with handles as in FIG. 4 are typically seen in products such as nail polish, glues, correction fluids, etc.

Brush segment 2, in FIGS. 1–4 (which may also be attached to the handles of the invention) can be any typical brush segment material. Typically such materials are natural such as hair, fur, bristle, or sponge, or synthetic fibers or foamed sponge-like materials.

FIGS. 5–7 are of handles of the invention and can be used in place of handle 3 of any of FIGS. 1–4. FIG. 5 shows handle 3 of the invention having a substantially egg-like or tear-drop portion 7 having a major axis and a minor axis. The minor axis B is shown clearly in FIGS. 8 and 9. Perpendicular to the minor axis is the major axis, one-half of which is shown in the Figures as dimension A. One end of the major axis tapers into shank 8. A part of portion 7 parallel to the major axis is cut away to provide a substantially flat thumbrest 9, seen in FIGS. 6, 9 and 10 but not visible in FIG. 5. FIG. 7 shows a side view of the handle of FIGS. 5 and 6.

Figure 8:
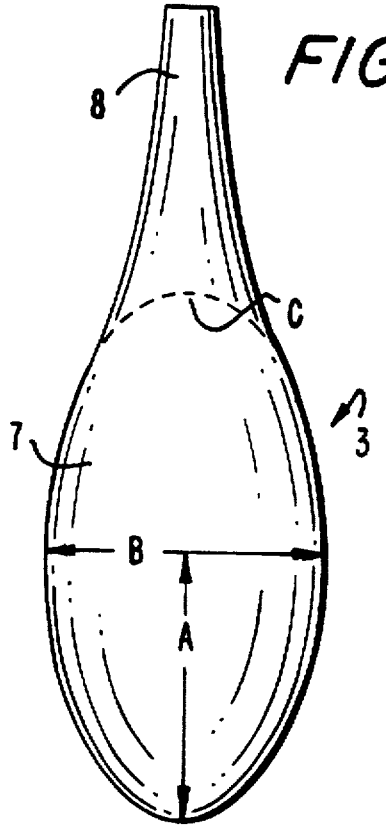
FIG. 8 is an additional top view of the handle of the invention.

FIG. 8 is the same view as FIG. 5, except for shown dimension A (one-half of the major axis), dimension B (the minor axis), and imaginary line C (representing the remainder of the "egg shape" without the stem of the handle).

Figure 9:
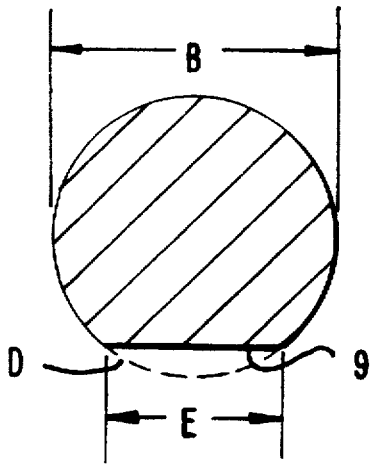
FIG. 9 is a cross-sectional view of FIG. 7 along line 9—9.

FIG. 9 shows a cross-section of FIG. 7 along line 9—9 with the minor axis B being shown as a diameter of the cross-section. Imaginary line D represents that portion of an otherwise circular cross-section which has been cut away to provide thumbrest 9. Dimension E is the width of the resulting thumbrest at its widest part.

Figure 10:
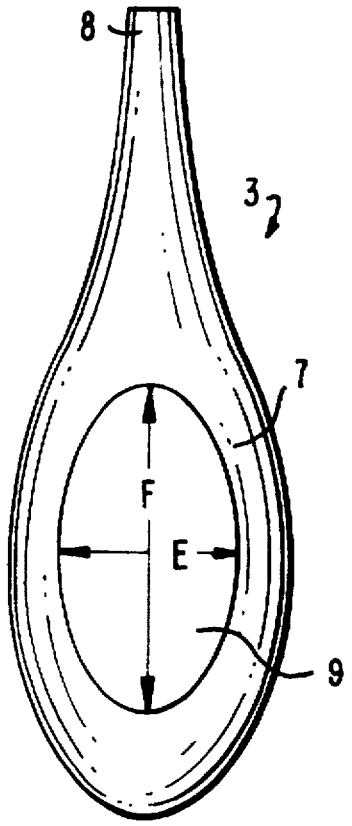
FIG. 10 is an additional bottom view of the handle of the invention.

FIG. 10 is the same as FIG. 6 except that dimension E (the widest part of the thumbrest) and F (the longest portion of the thumbrest) are shown as well.

In a preferred embodiment, the length of the handle 3 of the invention along the major axis (inclusive of so much of the shank as is shown in FIGS. 5–10 is about 85 mm to about 90 mm, preferably about 86 to about 88 mm, while the maximum diameter (i.e. the minor axis B) as seen in FIGS. 5 and 6 is generally about 25 mm to about 35 mm, preferably about 28 mm to about 32 mm, more preferably about 30 mm so that the handle of the invention comfortably fits an adult human hand. Larger and smaller handles are within the scope of this invention, especially those smaller handles designed for use by children. For those handles that are larger and smaller than those set forth above, the handles should be approximately proportional to those indicated for the adult hand. The proportion of the major axis length to minor axis length should be set in accordance with the normal contours of the human hand for the age group for which such handle is designed. More generally, the major axis, one-half of said major axis being shown in FIG. 8 as dimension of a correspondingly sized egg or teardrop should be from about 60 mm to 70 mm, preferably from about 64 mm to about 66 mm, more preferably about 65 mm, and the minor axis B (prior to removing the portion to provide thumbrest 9) should be from about 25 mm to about 35 mm, preferably from about 28 mm to about 32 mm, more preferably about 30 mm. Preferably, the ratio of major axis (twice dimension A) to minor axis B should be in the range of from about 1.9:1 to about 2.3:1. When adding in the shank, through that portion shown in FIGS. 5–7, the major axis length set forth above is extended typically by about 15 mm to about 25 mm, preferably from about 18 mm to about 22 mm, but such additional length is not included in the calculation of the ratios above. The length (F) of thumbrest 9 is generally from about 60% to about 80%, preferably from about 68% to about 73% of the length the major axis (neglecting the shank). For a handle having a major axis (neglecting the shank portion) of about 60 mm to about 70 mm, the thumbrest has a first axis parallel to the major axis of about 43 mm to about 50 mm, preferably about 45 mm. In the larger and smaller handles of the invention, the above dimensions are scaled proportionately so as to comfortably fit the hand of the user.

The handles of the invention can be made of any suitable material, although wood is deemed the best for artistic paint brushes, ceramic brushes, nail brushes, cosmetic brushes, and craft/hobby brushes. Other suitable materials may be plastic or metal. The handles may also be solid or hollow as desired, although solid handles are preferred.

In addition, the invention handles may also be adapted to receive and hold a brush by having a portion of shank 8 hollowed so as to receive such brush. The handles may further be hollowed so that they can receive and grip a cap-brush of FIG. 4 therein. Alternatively, such hollowed handles may also be threaded internally to the hollow space so as to enable the handle to simultaneously act as a cap-brush for a product.

The foregoing embodiments exemplify the invention, but do not limit it. Additional embodiments within the scope of the invention will be apparent to those of ordinary skill in the art.

I claim:

1. A substantially egg-like or tear drop shaped handle for a brush, said handle having a length, a width, and a depth, said handle having a major axis along said length and a minor axis along said width, in which a segment of said depth, parallel to the major axis, has been cut away so as to provide a flat surface, said flat surface providing a thumbrest when said handle is being held by a user, said handle, at either end of the major axis of the substantially egg-like shaped handle or a non-rounded end of the substantially tear shaped handle, adapted to receive, to be received by, or integrally manufactured with, the brush to be held by the handle, and said handle is of such a size that when in use by a user, and said user's thumb is resting on said flat surface, the end of the major axis distal the end which is received by, or integrally formed with the brush can rest comfortably against a portion of the palm of said user's hand.

2. The handle of claim 1 wherein said handle is adapted to receive, to be received by, or integrally manufactured with said brush through a tapered shank portion attached to the handle.

3. The handle of claim 1 wherein said brush is a paint brush,a cosmetic brush, or a ceramic brush.

4. The handle of claim 3 wherein said paint brush is an artistic paint brush.

5. The handle of claim 1, wherein said handle has a hollow recess at one end of said major axis of said substantially egg shaped handle or at a non-rounded end of said major axis of said tear-shaped handle and the interior of said hollow recess having a means adapted to receive a brush, a brush stem, or a brush connection means therein.

6. The handle of claim 5 wherein said interior within said hollow recess contains means for receiving a container so as to allow said handle to simultaneously act as a cap for said container.

7. The handle of claim 1 wherein said major axis is from about 60 mm to about 70 mm.

8. The handle of claim 1 wherein the minor axis of said handle is from about 25 mm to about 35 mm.

9. The handle of claim 1 wherein said major axis and said minor axis are in a proportion of major:minor of about 1.9:1 to about 2.3:1.

10. An improved brush with a handle, where the improvement comprises a substantially egg-like or tear drop shaped handle, said handle having a length, a width, and a depth, said handle having a major axis along said length and a minor axis along said width, in which a segment of said depth, parallel to the major axis, has been cut away so as to provide a flat surface, said flat surface providing a thumbrest when said handle is being held by a user, said handle, at either end of the major axis of the substantially egg-like shaped handle or a non-rounded end of the substantially tear shaped handle, receiving, being received by, or being integrally manufactured with the brush, and said handle is of such a size that when in use by a user, and said user's thumb is resting on said flat surface, the end of the major axis distal the end which is received by, or integrally formed with the brush can rest comfortably against a portion of the palm of said user's hand.

* * * * *